United States Patent [19]

Frank

[11] Patent Number: 4,609,616

[45] Date of Patent: Sep. 2, 1986

[54] BATH COMPOSITION FOR BLEACHING PHOTOGRAPHIC RECORDING MATERIALS AND BLEACHING PROCESS

[75] Inventor: Karl Frank, Leverkusen, Fed. Rep. of Germany

[73] Assignee: Agfa Gevaert Aktiengesellschaft, Leverkusen, Fed. Rep. of Germany

[21] Appl. No.: 708,672

[22] Filed: Mar. 6, 1985

[30] Foreign Application Priority Data

Mar. 15, 1984 [DE] Fed. Rep. of Germany ..... 3409443

[51] Int. Cl.[4] ..... G03C 5/44; G03C 7/40

[52] U.S. Cl. ..... 430/430; 430/393; 430/461

[58] Field of Search ..... 430/430, 461, 462, 393

[56] References Cited

U.S. PATENT DOCUMENTS

| | | | |
|---|---|---|---|
| 3,928,040 | 12/1975 | Shimamura et al. | 430/430 |
| 4,225,452 | 9/1980 | Leigh | 252/102 |
| 4,308,147 | 12/1981 | Sommer et al. | 252/180 |

*Primary Examiner*—Mary F. Downey

*Attorney, Agent, or Firm*—Connolly and Hutz

[57] ABSTRACT

Bath compositions for bleaching silver halide-containing recording materials contain an N-carboxyalkaneaminoalkane phosphonic acid or a salt thereof.

6 Claims, No Drawings

BATH COMPOSITION FOR BLEACHING PHOTOGRAPHIC RECORDING MATERIALS AND BLEACHING PROCESS

This invention relates to a bath composition for bleaching photographic recording materials and to a bleaching process with improved protection against precipitation.

When processing colour photographic recording materials and black and white reversal materials, bleaching is generally carried out after development. In this bleaching, developed silver is oxidized and may be removed from the material by subsequent fixing or by bleaching fixing. The compounds used for bleaching are oxidizing agents, mainly iron-III-compounds, bichromates and persulphates.

Complex-formers (so-called sequestering agents) may be added to such bleaching baths to prevent cloudiness and precipitation caused, e.g. by the formation of calcium compounds. It is also known to add corrosion inhibitors to such bleaching baths. Polyphosphates and amino group-containing carboxylic acids are examples of known water-softeners. The complex-forming action of polyphosphates, however, unfortunately leaves room for improvement. Bleaching baths containing a Fe-III-hexacyanoferrate as bleaching agent and an aminopolycarboxylic acid as corrosion inhibitor are disclosed in DE-AS 1,183,373 and U.S. Pat. No. 3,256,092. It is found, however, that considerable decomposition of the bleaching agent and of the amino polycarboxylic acid occurs in such baths within a relatively short time.

It is also known from DE-PS 2,732,277 to use carboxyalkane-aminoalkane-diphosphonic acids in photographic baths. According to European Patent Specification 0 000 930, such phosphonic acids are suitable for photographic developer baths. In JP-N 55 067 747 there are disclosed developers which contain such compounds together with a pyridine derivative to protect against precipitations. Reversal baths which may contain such compounds are disclosed in JP-N 55 146 449.

None of these citations relate to the particular problems which may occur in bleaching baths.

It is therefore an object of the present invention to provide stable and effective complex-formers for preventing precipitation and cloudiness in photographic bleaching baths. It is also an object of the present invention to provide inhibition against corrosion in such baths.

A bath composition for bleaching photographic recording material containing silver halide, comprising a bleaching agent and at least one complex-former, has now been found. According to the present invention, the complex-former is a N-carboxyalkane-aminoalkane phosphonic acid or a salt thereof. According to a preferred embodiment, the N-carboxyalkane-aminoalkane phosphonic acid corresponds to the following general formula (I):

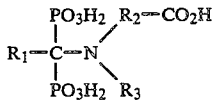

wherein $R_1$ represents an optionally substituted organic group;

$R_2$ represents a linking member;

$R_3$ represents hydrogen or an optionally substituted alkyl group; or $R_1$ and $R_3$ together represent the group required for completing an azacycloalkane ring.

In a particularly preferred embodiment, the substituents have the following meaning:

$R_1$—an optionally substituted alkyl group;

$R_2$—an optionally substituted (poly)methylene group;

$R_3$—hydrogen or $R^4$—COOH; and $R_4$—an optionally substituted (poly)methylene group.

The substituents may in turn be substituted with the usual substituents for complex-formers.

In an especially preferred embodiment, $R_1$ represents methyl $R_2$ represents ethylene or methylene; and $R_3$ represents H or carboxymethylene.

Particularly suitable compounds corresponding to general formula (I) are shown in Table I:

| Compound | $R_1$ | $R_2$ | $R_3$ |
|---|---|---|---|
| 1.1 | $CH_3$ | $CH_2$ | $CH_2$—$CO_2H$ |
| 1.2 | $CH_3$ | $C_2H_4$ | H |

The compounds to be used according to the present invention are known or may be prepared by known processes. Reference may be made to German Offenlegungsschrift Nos. 2,318,416 and 2,732,777 and 2,732,777 and to European Application No. 0 000 930.

The conventional bleaching agents may be used. These include compounds of polyvalent metals, such as iron (III) cobalt (III), chromium (IV), copper (II) and the like, peracids, quinones, nitroso compounds and the like. Salts and complexes of trivalent iron and persulphates are particularly suitable. Suitable iron-II complexes may be obtained, for example, from aminopolycarboxylate acids, e.g. ethylene diaminotetraacetic acid, nitrilotriacetic acid and 1,3-diamino-2-propanol-tetraacetic acid. The present invention, however, is particularly advantageous in connection with bleaching baths which contain, as bleaching agent, a hexacyanoferrate, in particular sodium, potassium or ammonium hexacyanoferrate.

The baths to be used according to the present invention may contain the other conventional constituents of bleaching baths, in particular re-halogenating agents, e.g. bromides. The conventional buffers for stabilizing the pH, such as boric acid and phosphoric acid compounds, may also be added. The pH of the baths to be used according to the present invention is generally from 3.5 to 8, preferably 5 to 7. The quantity of compound (I) added may be adjusted as desired to the given circumstances, the addition of from 1 to 20 mmol/liter, in particular, from 2 to 10 mmol/liter, being preferred, depending on the degree of hardness of the water used for preparing the bath.

The baths to be used according to the present invention may be used for the known photographic processes and are suitable in particular for the processing of colour photographic materials by negative or reversal processes. The present invention therefore also relates to a process for the production of photographic images in which a bleached silver halide material is developed, bleached and fixed, bleaching being carried out in the presence of a compound corresponding to the general formula (I).

Such processes include at least one development step in which the exposed silver halide is reduced to silver, a bleaching step to oxidize the reduced silver and fixing to remove the silver salts from the recording material. Bleaching and fixing may in certain circumstances be combined in one step in known manner.

The conventional developer substances may be used for the present invention. These preferably contain p-phenylene-diamine derivatives as colour developer substances, e.g.: N,N-dimethyl-p-phenylenediamine, 4-amino-3-methyl-N-ethyl-N-methoxy-ethylaniline, 2-amino-5-diethylamino-toluene, N-butyl-N-ω-sulphobutyl-p-phenylene diamine, 2-amino-5-(N-ethyl-N-β-methane sulphonamido-ethylamino)-toluene, N-ethyl-N-β-hydroxyethyl-p-phenylene diamine, N,N-bis-(β-hydroxyethyl)-p-phenylene diamine and 2-amino-5-(N-ethyl-N-β-hydroxy-ethylamino)-toluene. Other suitable colour developers have been described, for example, in J. Amer. Chem. Soc., 73, 3100, (1951). Black and white developer baths containing, for example, dihydroxybenzenes, 3-pyrazolidones, aminophenols, 1-phenyl-3-hydrazolines, ascorbic acid or other conventional developer substances may, of course, also be used.

Compounds protecting against oxidation, e.g. hydroxylamine, ascorbic acid and certain sugars and glucosamine, complex-formers, the conventional buffer compounds, development accelerators, antifogging agents, competing couplers, surface active agents and white toners may also be added to the developer compositions. Reference may be made in this connection to Ullmanns Enzyklopadie der technischen Chemie, 4th Edition, Volume 18, 1979, in particular pages 451, 452 and 463–465. A detailed description of suitable developer compositions and methods of processing is given by Grant Haist, Modern Photographic Processing, John Wiley and Sons, 1973, Volumes 1 and 2.

The conventional fixing baths containing a silver halide solvent as the main component may be used for fixing. Thiosulphates are particularly preferred. The fixing baths may also contain sulphites, borates and other conventional additives.

The present invention is particularly suitable for rapid processing at elevated temperatures.

Recording materials for colour photography may contain the necessary couplers for producing a colour image, but these couplers may also be present in the developer composition.

Recording materials containing non-diffusible colour couplers are particularly suitable. These generally have at least one non-diffusible colour coupler for producing the cyan partial colour image associated with each red-sensitive silver halide emulsion layer, generally a coupler of the phenol or α-naphthol series, while at least one non-diffusible colour coupler for producing the magenta partial colour image is associated with each green-sensitive silver halide emulsion layer, usually a colour coupler of the 5-pyrazolone or indazolone series. Each blue-sensitive silver halide emulsion layer generally has at least one non-diffusible colour coupler for producing the yellow partial colour image associated there with, generally a colour coupler having an open-chain β-diketomethylene or β-diketomethine group.

Information on this subject may be found, for example, in the publications "Farbkuppler" by W. Pelz in "Mitteilungen aus den Forschungslaboratorien der Agfa, Leverkusen/Muchen", Volume III, page 111 (1961); K. Venkataraman in "The Chemistry of Synthestic Dyes", Volume 4, 341 to 387, Academic Press (1971); and T. H. James, "The Theory of the Photographic Process", 4th Edition, pages 353–362.

The colour couplers may be either conventional 4-equivalent couplers or they may be 2-equivalent couplers. Among the 2-equivalent couplers should be included the known white couplers, which do not produce a dye in reaction with colour developer oxidation products, as well as the DIR couplers, which carry in the coupling position a removable group which may be released as diffusible development inhibitor.

Other suitable additives for photographic recording materials are indicated in the Journal, "Product Licensing Index", Volume 92, December 1971, pages 107 to 110, and in Research Disclosure No. 22534 of January 1983.

The halides present in the silver halide emulsions used in the materials may be chloride, bromide, iodide or mixtures of these halides. It is preferred to use bromide and iodo-bromide emulsions, which may be ripened and optically sensitized in the conventional manner. See in particular Ullmanns Enzyklopadie der technischen Chemie, 4th Edition, Volume 18, pages 424 et seq and 431 et seq. The recording materials may be stabilized. Azaindenes are suitable stabilizers, particularly tetra and pentaazaindenes, especially those which are substituted with hydroxyl or amino groups. Examples of such compounds are described, for example, in the article by Birr, Z. Wiss Phot. 47 (1952), 2–58. Other suitable stabilizers are, inter alia, heterocyclic mercapto compounds, such as phenylmercaptotetrazole, quaternary benzothiazole derivatives and benzotriazole.

EXAMPLE 1

Complex-formers were added as indicated in Table 2 to parts of a bleaching bath having the composition given below and containing $K_2[Fe(CN)_6]$ as bleaching agent:

$K_3[Fe(CN)_6]$: 50 g
KBr: 15 g
$Na_2HPO_4$: 7 g
$KH_2PO_4$: 10 g
Made up with water to 1 liter.

The bleaching baths were stored at 22° C. for 4 weeks. A fall in the concentration of $K_3[Fe(CN)_6]$ accompanied by the formation of $K_4[Fe(CN)_6]$ occurred. This fall in concentration was in some cases sharp, depending on the complex-former added (see Table 2). The higher the concentration of $K_4[Fe(CN)_6]$ obtained, the greater was also the (unwanted) fall in concentration of $K_3[Fe(CN)_6]$

TABLE 2

| Bath | Additive Compound | Additive g/l | $K_4[Fe(CN)_6]$ after 4 weeks g/l |
|---|---|---|---|
| 1 | Sodium Polyphosphate | 6 | 2.2 |
| 2 | Ethylene diaminotetra-acetic acid | 3 | 17.7 |
| 3 | Isopropanol diamino-tetraacetic acid | 10 | 27.4 |
| 4 | Diethylene triamine-pentaacetic acid | 10 | 37.5 |
| 5 | 1.1 (invention) | 0.74 | 3.7 |
| 6 | 1.2 (invention) | 1.5 | 3.0 |

In bath No. 1, a precipitate which rendered the bath difficult to use as bleaching bath formed after only a few days. Samples 2 to 4 were unacceptable owing to the considerable reduction in concentration of bleaching agent, which was, moreover, accompanied by a decomposition of the complex-former added. Samples 5 and 6 according to the present invention showed no precipitate even when they had been left to stand for 4 weeks, only insignificant reduction in the concentration of bleaching agent.

EXAMPLE 2

A commercial colour photographic recording material was exposed image-wise, subjected to the process of development described in British Journal of Photography (1974) page 97 et seq and then bleached with the freshly prepared baths 1,5 and 6 indicated in Example 1. Baths 5 and 6 according to the present invention produced substantially the same results as bath 1 (much better storage stability of baths 5 and 6).

I claim:

1. Bath composition for bleachin silver halide containing photographic recording materials, which composition contains a hexacyanoferrate as bleaching agent and at least one complex-former comprising as complex-former a compound corresponding the following general formula I:

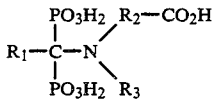

I or a salt thereof, wherein $R_1$ represents an organic group;

$R_2$ represents a (poly)methylene group which may be substituted;

$R_3$ represents hydrogen or an alkyl group which may be substituted or $R_1$ and $R_3$ together represent the group required for completing an azacycloalkane ring.

2. Bath composition according to claim 1, wherein $R_1$ represents an alkyl group which may be substituted;

$R_2$ represents a (poly)methylene group which may be substituted;

$R_3$ represents hydrogen or $R^4$—COOH; and $R_4$ represents a (poly)methylene group which may be substituted.

3. Bath composition according to claim 1, wherein $R_1$ represents methyl;

$R_2$ represents ethylene or methylene, and $R_3$ represents H or carboxymethylene.

4. Bath composition according to claim 1, characterised in that it contains the N-carboxyalkane-aminoalkane phosphonic acid in a quantity of from 1 to 20 mmol/l.

5. Bath composition according to claim 1, having a pH of from 3.5 to 8.

6. In a process for production of photographic images, in which an exposed silver halide recording material is developed, bleached and fixed in steps in said process, the improvement comprising bleaching the silver halide recording material in a bleaching bath containing a hexacyanoferrate as bleaching agent and a compound corresponding to the following formula

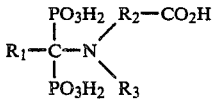

I or a salt thereof, wherein $R_1$ represents an organic group;

$R_2$ represents a (poly)methylene group which may be substituted $R_3$ represents hydrogen or an alkyl group which may be substituted or $R_1$ and $R_3$ together represent the group required for completing an azacycloalkane ring.

* * * * *